US009707449B2

(12) United States Patent
Wu

(10) Patent No.: US 9,707,449 B2
(45) Date of Patent: Jul. 18, 2017

(54) WAIST TWISTING APPARATUS

(71) Applicant: Dong-Her Wu, Changhua (TW)

(72) Inventor: Dong-Her Wu, Changhua (TW)

( * ) Notice: Subject to any disclaimer, the term of this patent is extended or adjusted under 35 U.S.C. 154(b) by 0 days.

(21) Appl. No.: 15/049,398

(22) Filed: Feb. 22, 2016

(65) Prior Publication Data

US 2017/0113097 A1 Apr. 27, 2017

(30) Foreign Application Priority Data

Oct. 26, 2015 (TW) ..... 104134670 A

(51) Int. Cl.

| | |
|---|---|
| ***A63B 26/00*** | (2006.01) |
| ***A63B 21/22*** | (2006.01) |
| ***A63B 21/00*** | (2006.01) |
| *A63B 23/00* | (2006.01) |

(52) U.S. Cl.

CPC ..... *A63B 26/00* (2013.01); *A63B 21/22* (2013.01); *A63B 21/4033* (2015.10); *A63B 21/4049* (2015.10); *A63B 2023/003* (2013.01); *A63B 2208/0233* (2013.01); *A63B 2225/093* (2013.01)

(58) Field of Classification Search

CPC ..... A63B 21/4029; A63B 2225/093; A63B 22/18; A63B 23/0205; A63B 23/0211; A63B 2208/0233; A63B 23/03541; A63B 21/4047; A63B 23/0222; A63B 22/20; A63B 2023/003; A63B 21/0004; A63B 2071/025; A63B 22/0087; A63B 21/4033; A63B 21/4049; A63B 21/22; A63B 26/00

USPC ..... 482/142

See application file for complete search history.

(56) References Cited

U.S. PATENT DOCUMENTS

| | | | | |
|---|---|---|---|---|
| 6,428,451 | B1 * | 8/2002 | Hall | A63B 22/18 482/146 |
| 2007/0298945 | A1 * | 12/2007 | Mehta | A63B 22/14 482/130 |
| 2008/0207412 | A1 * | 8/2008 | Lin | A63B 21/015 482/140 |
| 2011/0160026 | A1 * | 6/2011 | Perez, Jr. | A47C 3/0252 482/142 |
| 2014/0045664 | A1 * | 2/2014 | Hockridge | A63B 26/00 482/142 |
| 2014/0162852 | A1 * | 6/2014 | Ho | A63B 21/023 482/127 |
| 2015/0209612 | A1 * | 7/2015 | Shen | A63B 21/068 482/147 |
| 2015/0273262 | A1 * | 10/2015 | Hsieh | A63B 21/068 482/142 |

* cited by examiner

*Primary Examiner* — Andrew S Lo
(74) *Attorney, Agent, or Firm* — Che-Yang Chen; Law Office of Scott Warmuth

(57) ABSTRACT

A waist twisting apparatus may include a base, a supporting portion, and a seat. A platform is formed at a top portion of the base, and a central portion of the platform has a first axle hole. The supporting portion vertically formed on the base comprises a main body, and a first edge and a second edge thereof are respectively formed at an inner edge and an outer edge of the main body. The main body is further connected to a first axle rod and a second axle rod respectively, and the first axle rod comprises a first connecting portion while the second axle rod has a second connecting portion. The wheel is pivotally installed at a bottom portion of the main body. The seat has a bottom shell, and a second axle hole is formed at a center bottom portion of the bottom shell.

8 Claims, 15 Drawing Sheets

WAIST TWISTING APPARATUS

FIELD OF THE INVENTION

The present invention relates to a waist twisting apparatus, and more particularly to a waist twisting apparatus used for achieving the waist twisting exercise.

BACKGROUND OF THE INVENTION

Generally, referring to FIG. 18, a first type of conventional waist twisting apparatus (60) comprises a first base (61), and a rotary post (62) is rotatably attached to a top portion of the first base (61). This kind of the waist twisting apparatus (60) can be stably placed on the ground, and the user can simply start the waist twisting movement by directly sitting on the rotary post (62). However, the waist twisting apparatus (60) mentioned above is disadvantageous because: (i) the waist twisting apparatus (60) does not match ergonomics when the user needs to sit down on the rotary post (62), and enters a position where the user's feet are off the ground and the legs are tucked into the body in an uncomfortable position before using the waist twisting apparatus (60); and (ii) the movement described in (i) may hamper the activities of a lower body of the user and the stretch of limbs, and reduce exercise effect. Furthermore, after a period of time, the user may get hurt.

Another type of conventional waist twisting apparatus (70), referring to FIG. 19, comprises a base (71), and four stabilizer beams (711) respectively protruding from a bottom portion of the base (71) is configured to stably support the base (71) on the ground. A crank (72) protruding from a top central portion of the base (71) is configured to connect to a cushion (73) which is adapted for a user to sit and achieve waist twisting exercise upon. However, this kind of the conventional waist twisting apparatus (70) is still unfavorable because: (i) although the stabilizer beams (711) are installed to support the base (71) of the waist twisting apparatus (70), the user still needs to sit in an uncomfortable way such as legs elevated; (ii) the crank (72) of the waist twisting apparatus (70) is exposed to the air, so that it is more likely to be contaminated or further blocked by foreign matters such as dusts; and (iii) Since the crank (72) is formed in a Z-shaped, the crank (72) is in an eccentric position of the base (71). In other word, the position of the cushion (73) is hanged above the base (71). Thus, the weight of the user pressing on the cushion (73) may cause larger frictions acting on a joint point between the crank (72) and the second base (71), further affecting the smoothness of rotation of the crank (72).

In light of each of two types mentioned above having its shortcomings, one of my previous inventions disclosed a waist twisting apparatus with a seat (80) in Taiwan Patent No. 201505586, referring to FIG. 20, comprising a base (81) and a crank (82). A lower end of the crank (82) is rotatably mounted on the base (81) while an upper end thereof is connected to a rotary post (83). Moreover, a seat (84) secured on a top portion of the rotary post (83) is configured for a user to sit upon.

However, the conventional waist twisting apparatus (80) is disadvantageous because: (i) the crank (82) is exposed to the air, so that it is more likely to be contaminated or further blocked by foreign matters such as dusts; (ii) the seat (84) further comprises a pair of handles (841) respectively formed at two lateral edge thereof. Although the handles (841) can provide a handhold for the user, it may reduce exercise effect of the waist of the user when the user exerts force on the handles (841). Furthermore, the users may tear their hand muscles accidentally during the twisting exercise; and (iii) this type of conventional waist twisting apparatus (80) has more components, including the base (81), the crank (82), the rotary post (83) and the seat (84), which increases the volume and the complexity of the waist twisting apparatus (80) and further raises the cost and the assembly difficulty of production. Therefore, there remains a need for a new and improved design for a waist twisting apparatus to overcome the problems presented above.

SUMMARY OF THE INVENTION

The present invention provides a waist twisting apparatus, which comprises a base, a supporting portion, and a seat. A platform formed at a top portion of the base is configured to allow a wheel of the supporting portion to slide thereon, and a central portion of the platform has a first axle hole. The supporting portion vertically formed on the base comprises a main body, and a first axle rod formed at a lower inner portion thereof is configured to connect to the first axle hole. The main body further has a vertical first edge and a vertical second edge, which are respectively located near the first axle rod and far from the first axle rod, and a second axle rod is formed at an upper outer portion of the main body which is close to the second edge of the main body. Moreover, the first axle rod comprises a first connecting portion which downwardly sticks out of a bottom portion of the main body, and the second axle rod has a second connecting portion which upwardly protrudes from a top portion of the main body. The wheel is pivotally installed at the bottom portion of the main body which is close to the second edge. The seat has a bottom shell, and a second axle hole is formed at a center bottom portion thereof.

Comparing with conventional waist twisting apparatus, the present invention is advantageous because: (i) the height of the seat is slightly higher than the knee of general adult user, so that the user can comfortably sit on the seat without over bending knees or crossing legs, thus lowering the possibility of injuries during the twisting exercise and enhancing the exercise effect; (ii) since the first axle rod and the second axle rod are installed inside the main body instead of being exposed to the air, the first axle rod and the second axle rod are less likely to be stuck by foreign matters such as dusts; (iii) when the waist twisting apparatus in the present invention is in used, the feet of the user can stand on the floor, so that there is no need to install handles for providing handholds for the user, thus lowering the complexity in structure, improving the exercise effect and preventing the user from getting hurt; (iv) the user together with the seat is supported by the wheel instead of being hanged on the air, so that the structure can prevent the base from being pushed from the oblique lower direction by the first axle rod, thus smoothing the rotation of the supporting portion; (v) by pivotally connecting the base, the supporting portion and the seat, the waist twisting apparatus in the present invention has advantages in simplifying the structure, reducing the volume, and lowering the difficulty of assembling and the cost of produce; and (vi) since the bolt can secure the supporting portion together with the seat on the base, the waist twisting apparatus in the present invention can also be used as a chair for a user.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
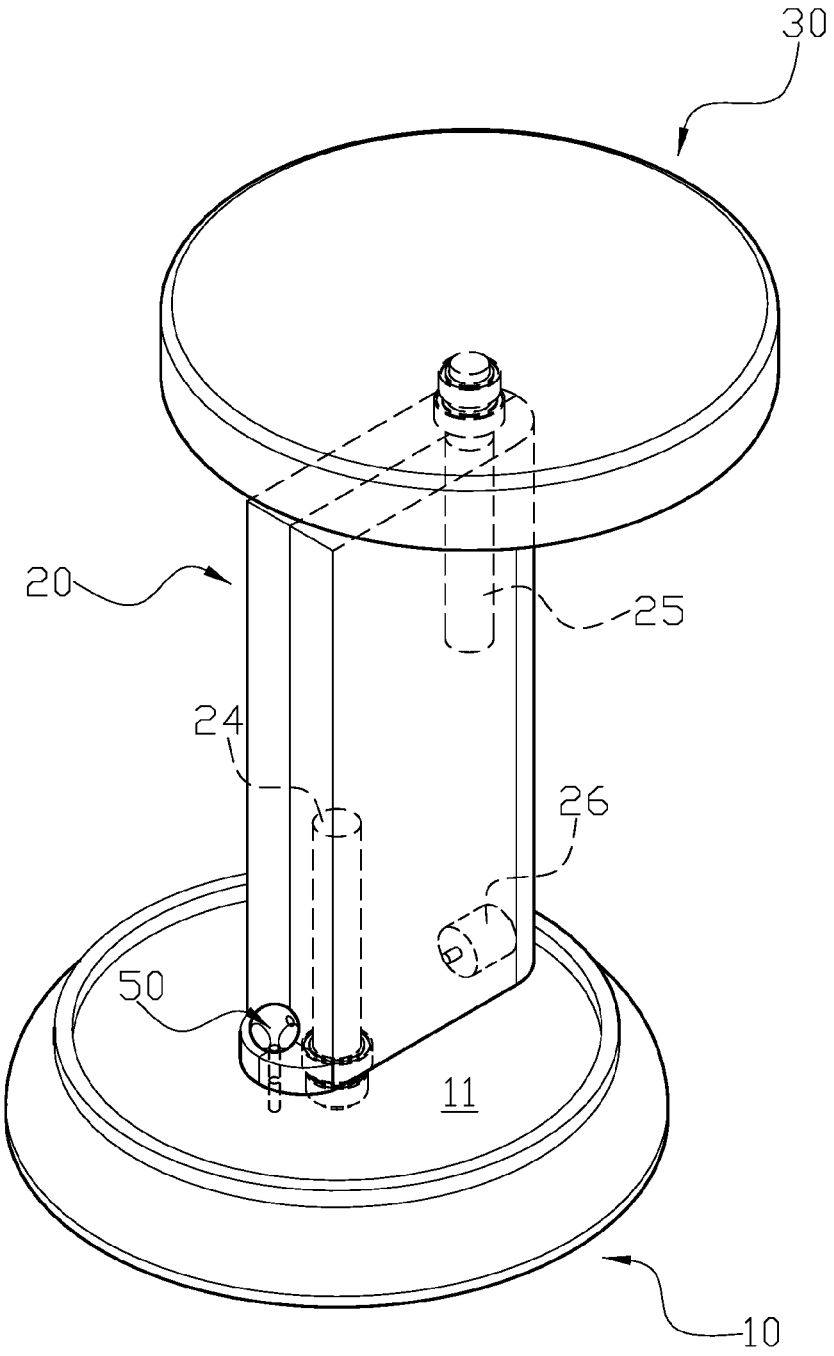
FIG. 1 is a three-dimensional assembly view of a waist twisting apparatus in the present invention.
Figure 2:
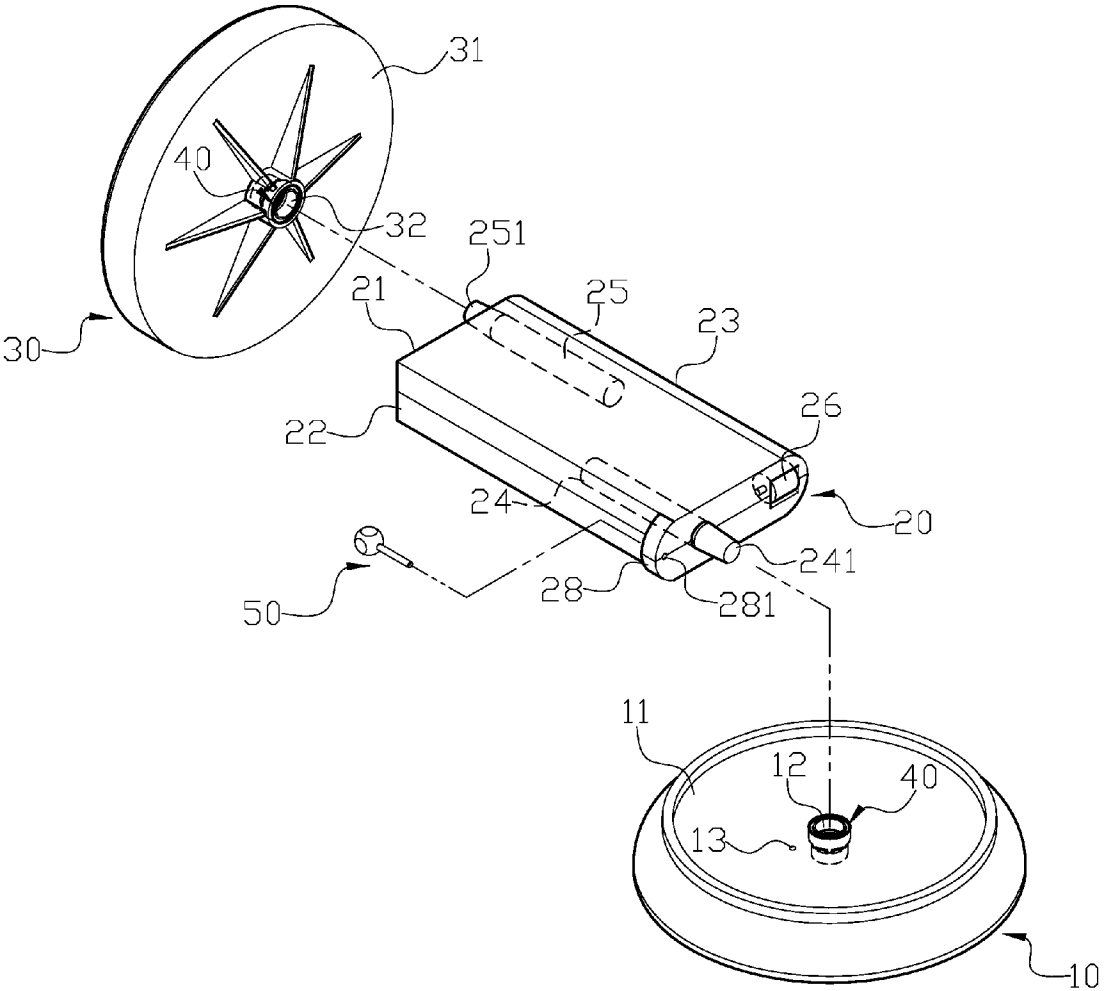
FIG. 2 is a three-dimensional exploded view of the waist twisting apparatus in the present invention.
Figure 3:
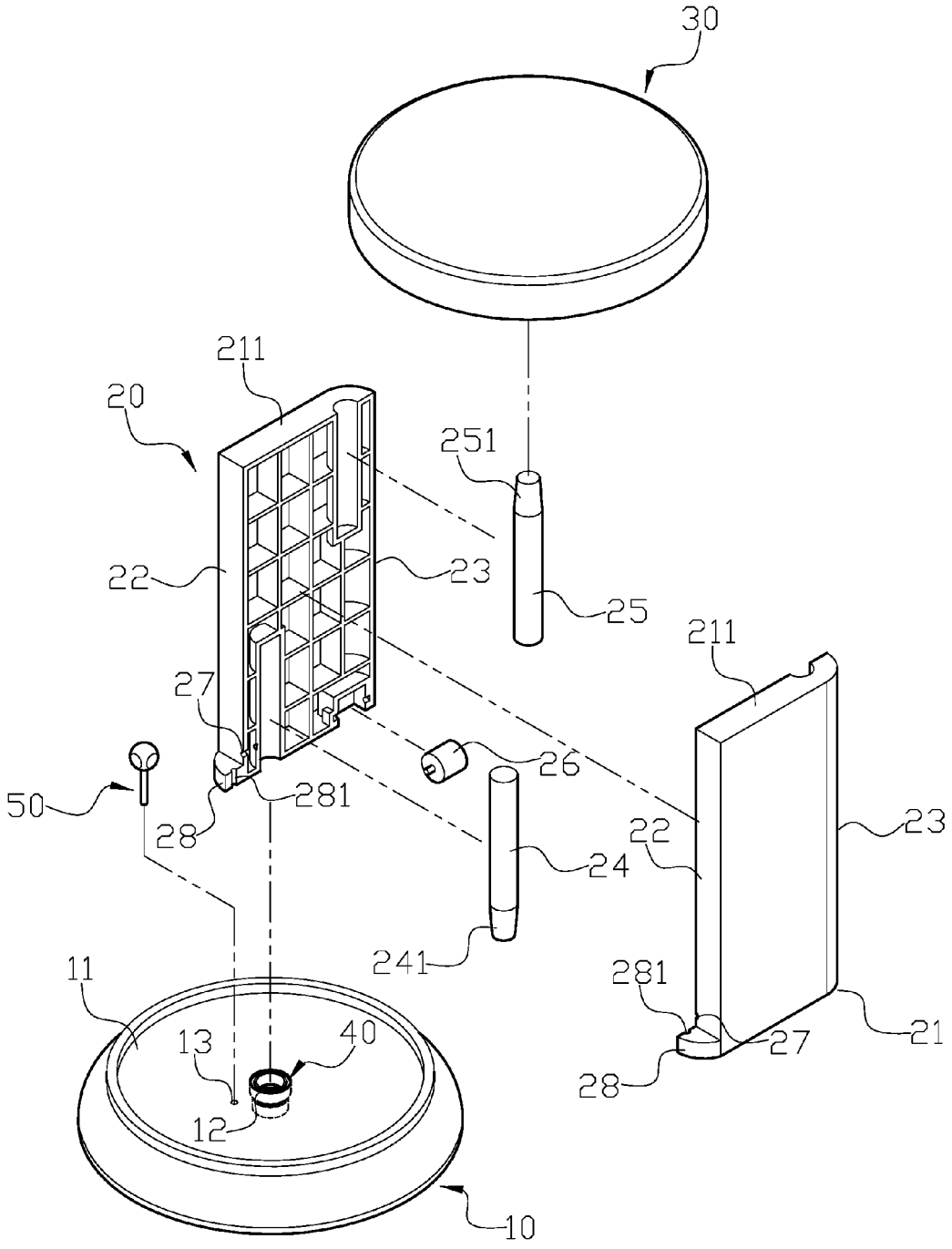
FIG. 3 is a detail exploded view of the waist twisting apparatus in the present invention.

In order to further understand the goal, characteristics and effect of the present invention, a number of embodiments along with the drawings are illustrated as following:

Referring to FIGS. 1 to 3, the present invention provides a waist twisting apparatus, which comprises a base (10), a supporting portion (20), and a seat (30). A platform (11) formed at a top portion of the base (10) is configured to allow a wheel (26) of the supporting portion (20) to slide thereon, and a central portion of the platform (11) has a first axle hole (12). The supporting portion (20) vertically formed on the base (10) comprises a main body (21), and a first axle rod (24) formed at a lower inner portion thereof is configured to connect to the first axle hole (12). The main body (21) further has a vertical first edge (22) and a vertical second edge (23), which are respectively located near the first axle rod (24) and far from the first axle rod (24), and a second axle rod (25) is formed at an upper outer portion of the main body (21) which is close to the second edge (23) of the main body (21). Moreover, the first axle rod (24) comprises a first connecting portion (241) which downwardly sticks out of a bottom portion of the main body (21), and the second axle rod (25) has a second connecting portion (251) which upwardly protrudes from a top portion of the main body (21). The wheel (26) is pivotally installed at the bottom portion of the main body (21) which is close to the second edge (23). The seat (30) has a bottom shell (31), and a second axle hole (32) is formed at a center bottom portion thereof.

Structurally, referring to FIG. 1, the supporting portion (20) is downwardly connected to the base (10) by inserting the first connecting portion (241) into the first axle hole (12), and is upwardly connected to the seat (30) by inserting the second connecting portion (251) into the second axle hole (32). Thus, each of the base (10) and the seat (30) can respectively rotate about the first connecting portion (241) and the second connecting portion (251) of the supporting portion (20), and the wheel (26) is borne against the platform (11) of the base (10). Furthermore, because of the design of the supporting portion (20), the height of the seat (30) is slightly higher than the height of the knee of general adult user.

Each of the first axle hole (12) of the base (10) and the second axle hole (32) of the seat (30) respectively has two bearings (40) which are configured to allow the first connecting portion (241) and the second connecting portion (251) to rotate about the first axle hole (12) and the second axle hole (32) respectively. Moreover, each of the first connecting portion (241) and the second connecting portion (251) is connected to the bearings (40) in a cone-shaped coordination.

Figure 4:
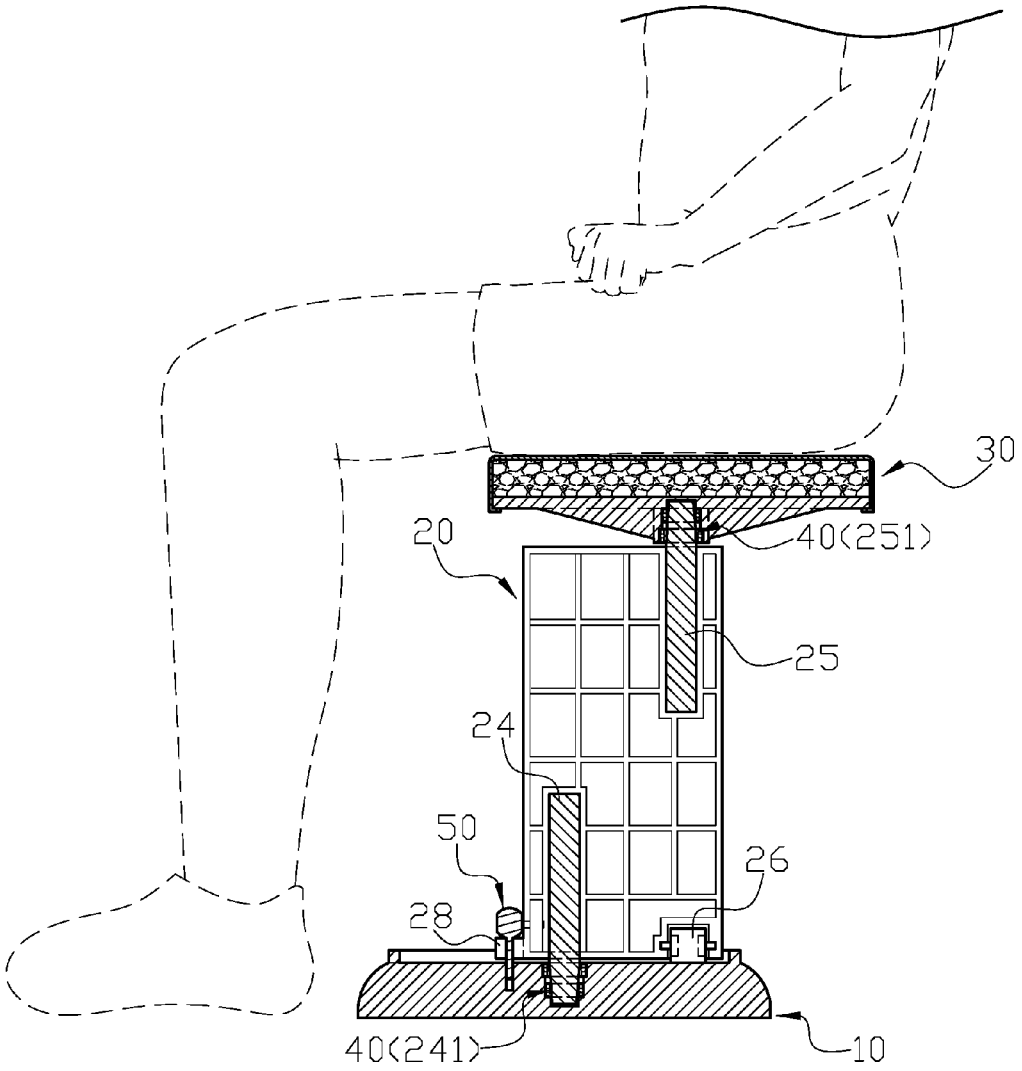
FIG. 4 is a schematic view of the waist twisting apparatus in the present invention when a user sitting thereon.
Figure 5:
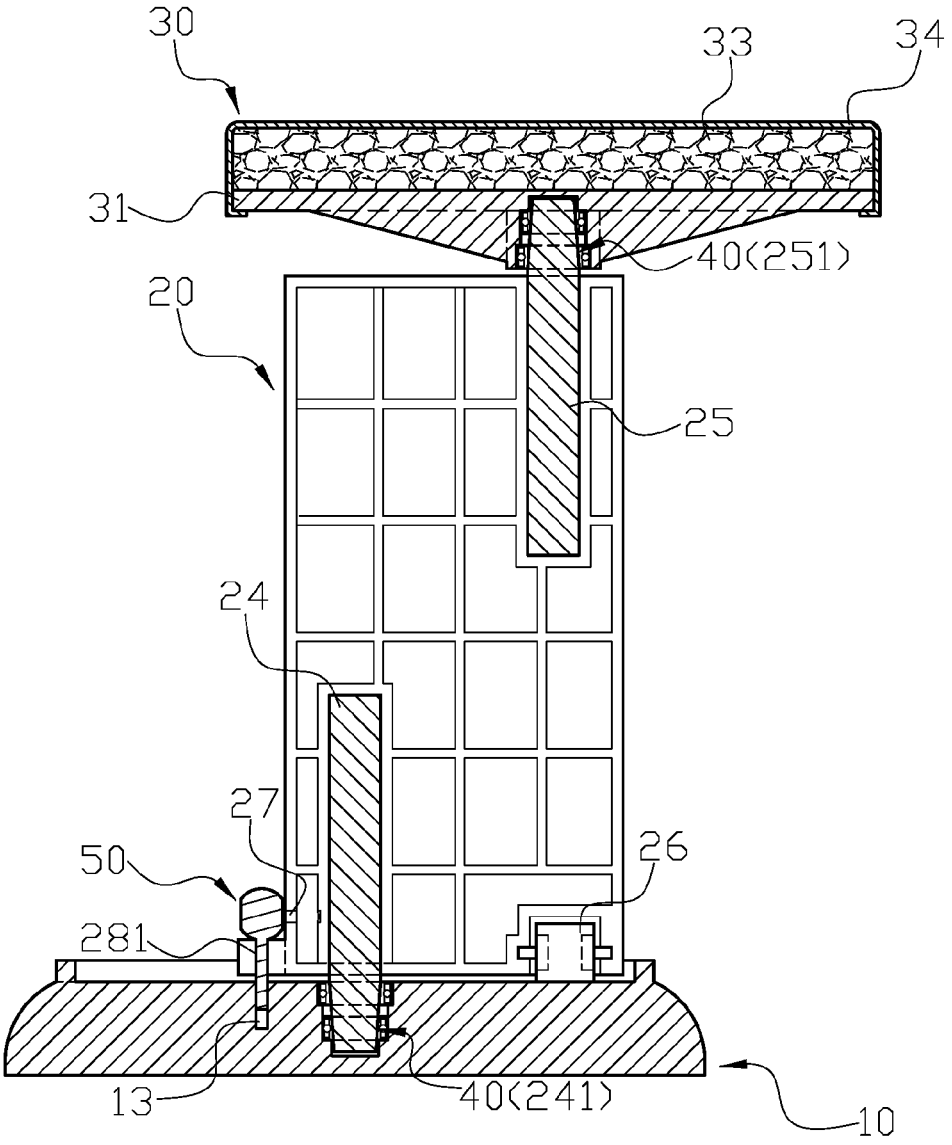
FIG. 5 is a sectional view of the waist twisting apparatus in the present invention when a supporting portion is secured on a base by a bolt.
Figure 6:
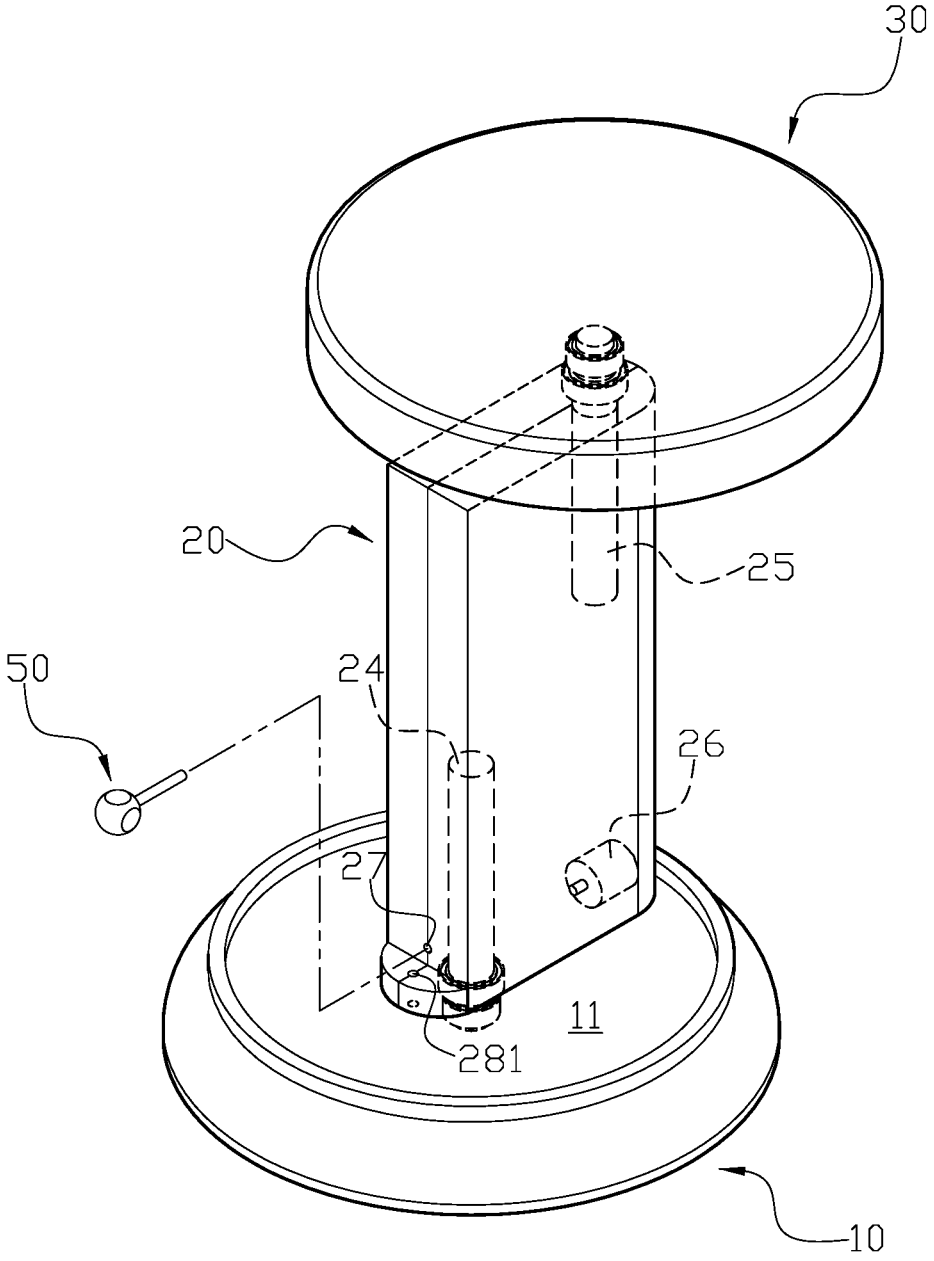
FIG. 6 is a schematic view of the waist twisting apparatus in the present invention when the bolt is inserted into a connecting hole of the supporting portion.
Figure 7:
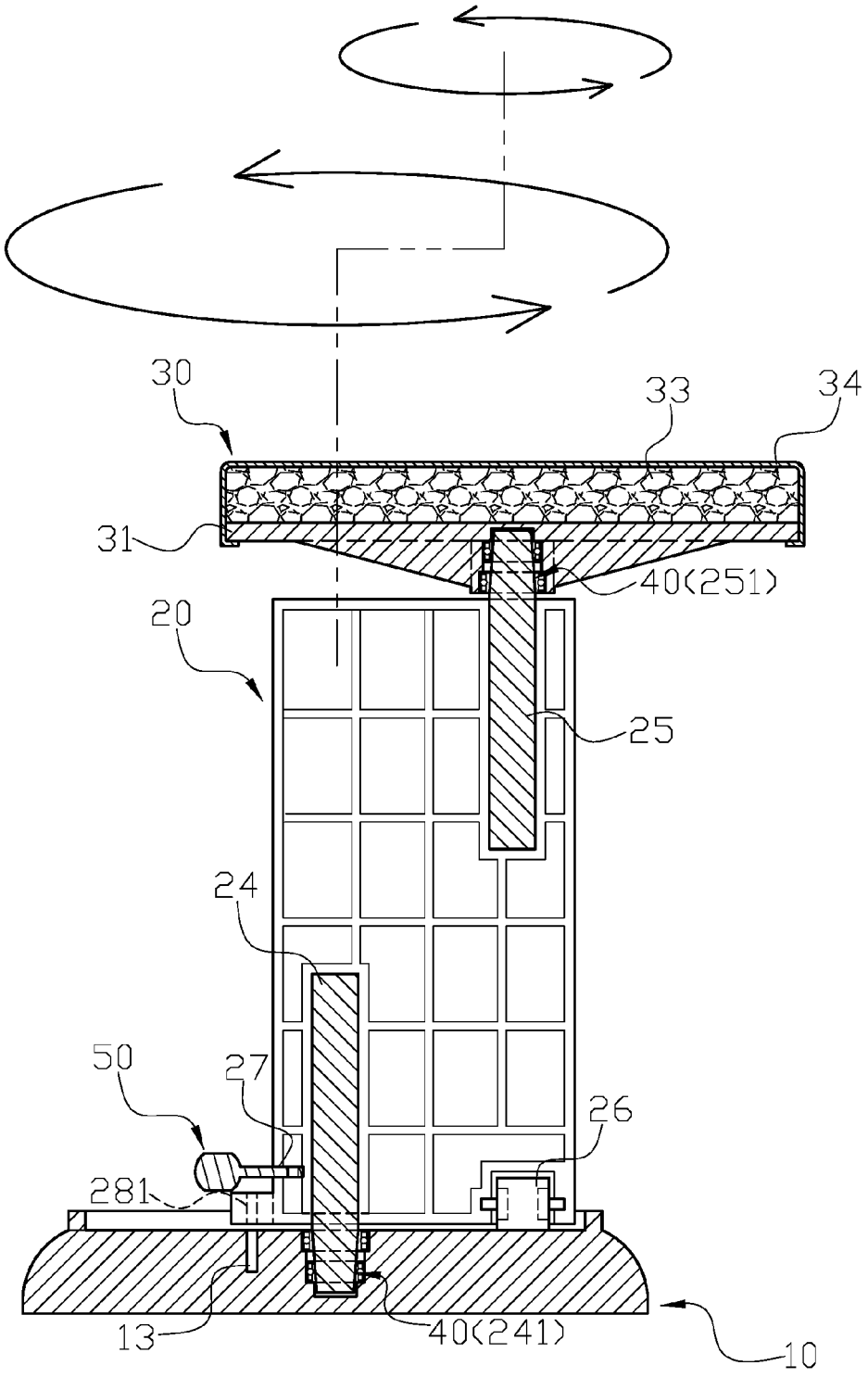
FIG. 7 is operating view of the waist twisting apparatus in the present invention.
Figure 9:
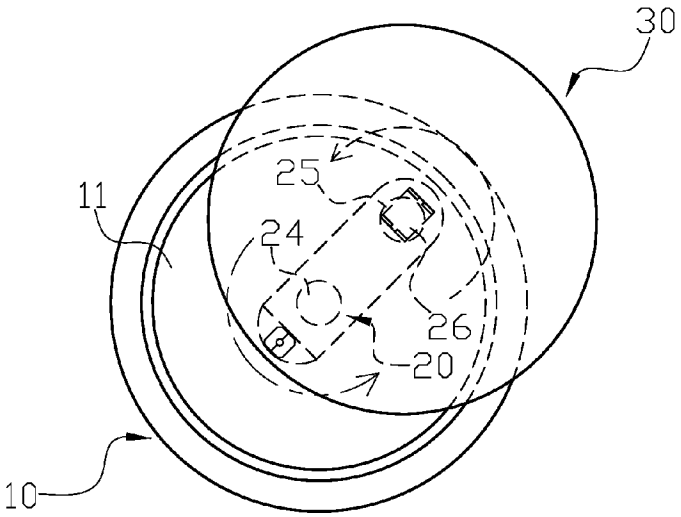
FIG. 9 is a plan view when the waist twisting apparatus of the present invention is in use.
Figure 8:
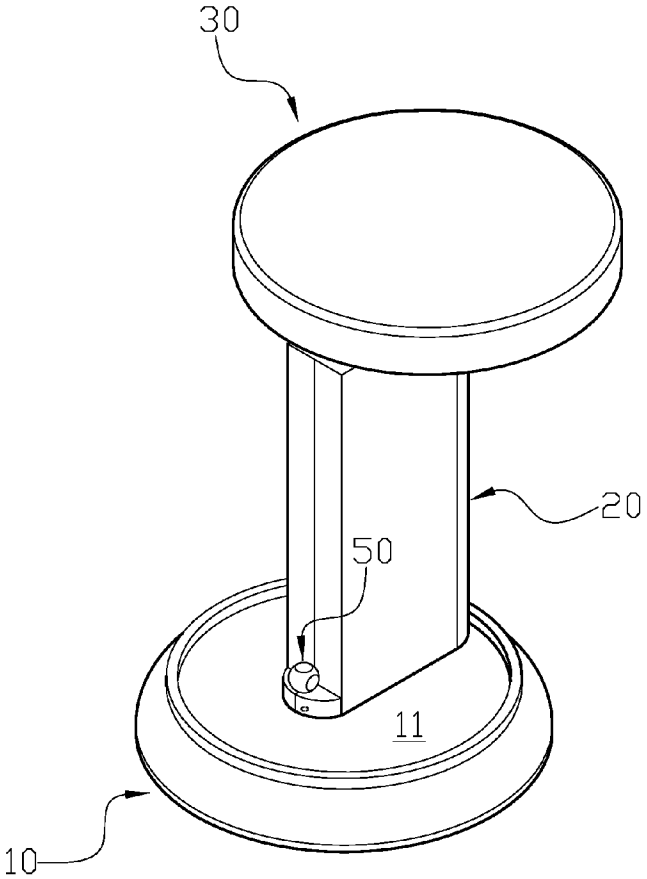
FIG. 8 is a three-dimensional view when the waist twisting apparatus of the present invention is in use.
Figure 11:
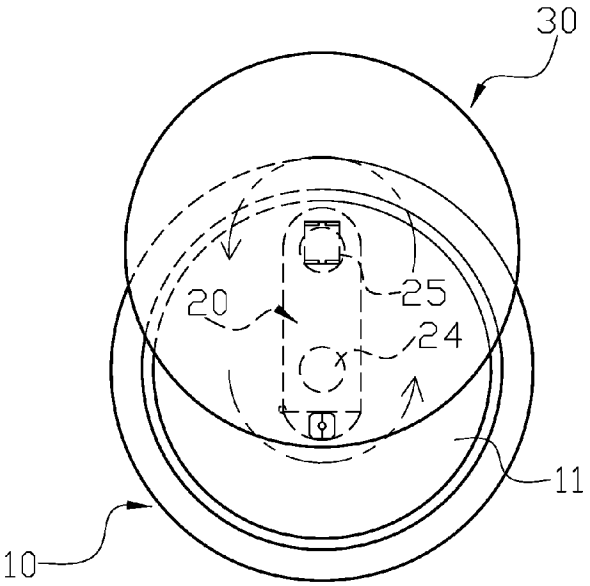
FIG. 11 is another plan view when the waist twisting apparatus of the present invention is in use.
Figure 10:
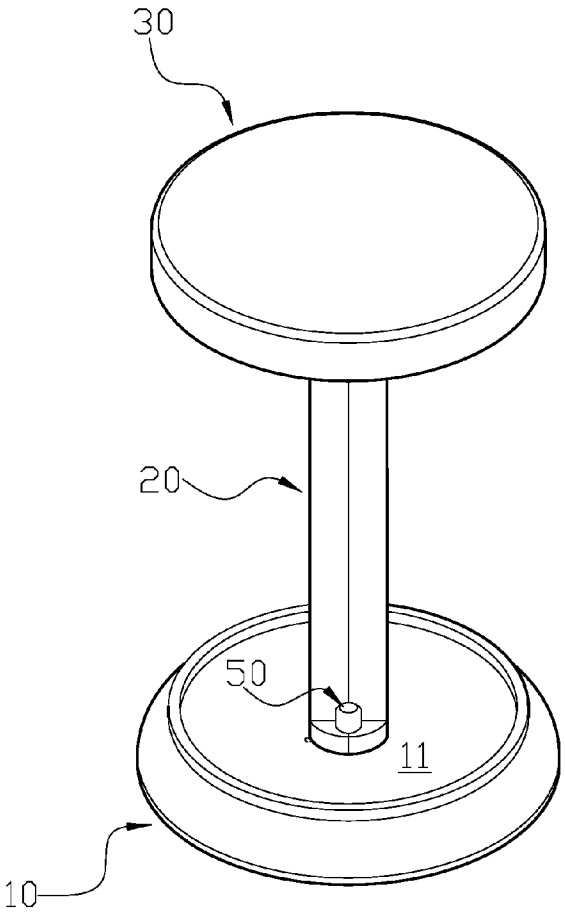
FIG. 10 is another three-dimensional view when the waist twisting apparatus of the present invention is in use.
Figure 13:
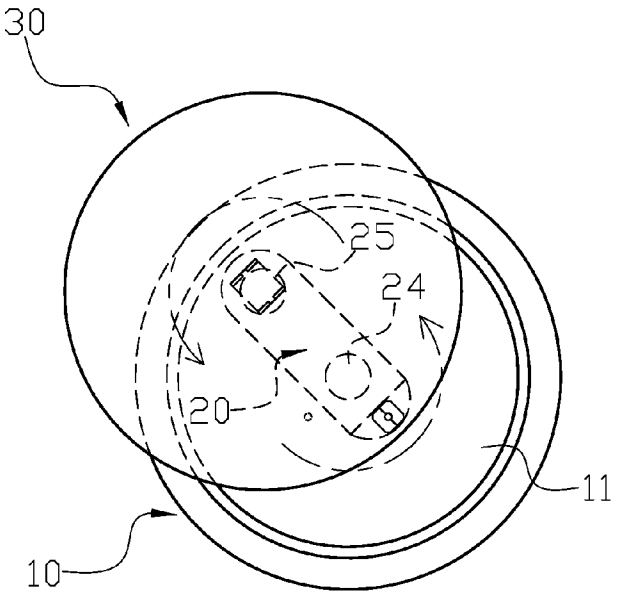
FIG. 13 is still another plan view when the waist twisting apparatus of the present invention is in use.
Figure 12:
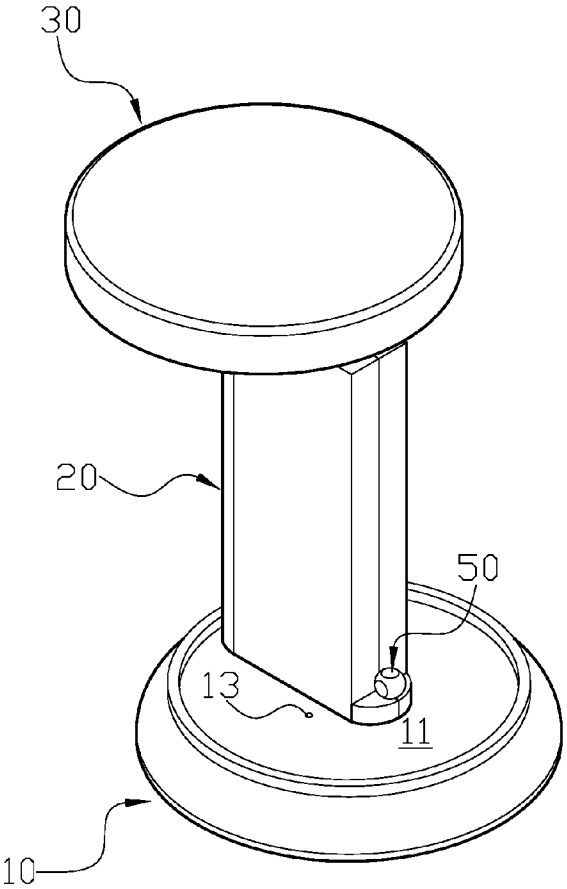
FIG. 12 is still another three-dimensional view when the waist twisting apparatus of the present invention is in use.
Figure 15:
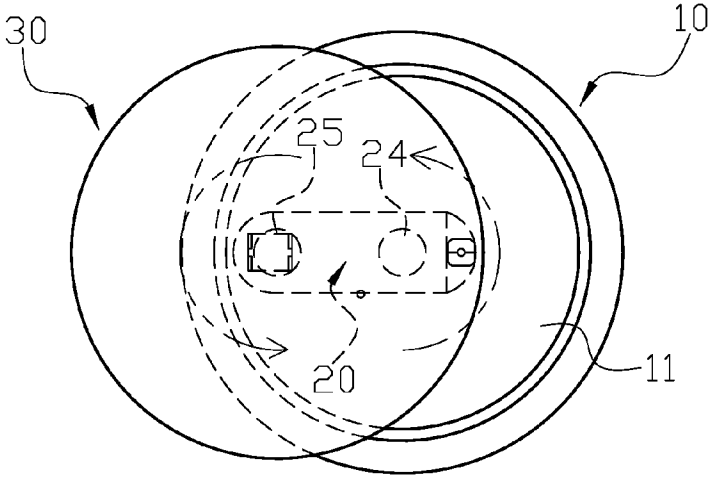
FIG. 15 is a further plan view when the waist twisting apparatus of the present invention is in use.
Figure 14:
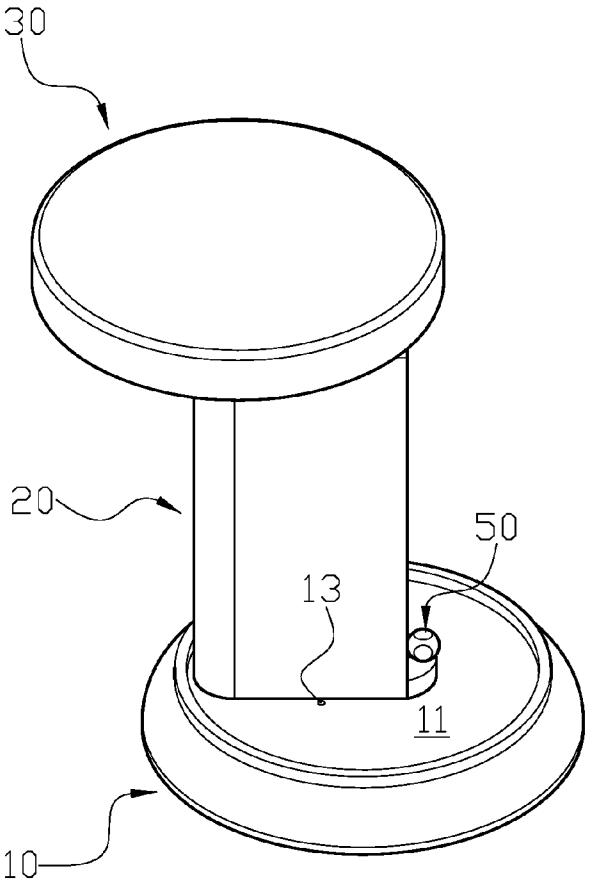
FIG. 14 is a further three-dimensional view when the waist twisting apparatus of the present invention is in use.
Figure 17:
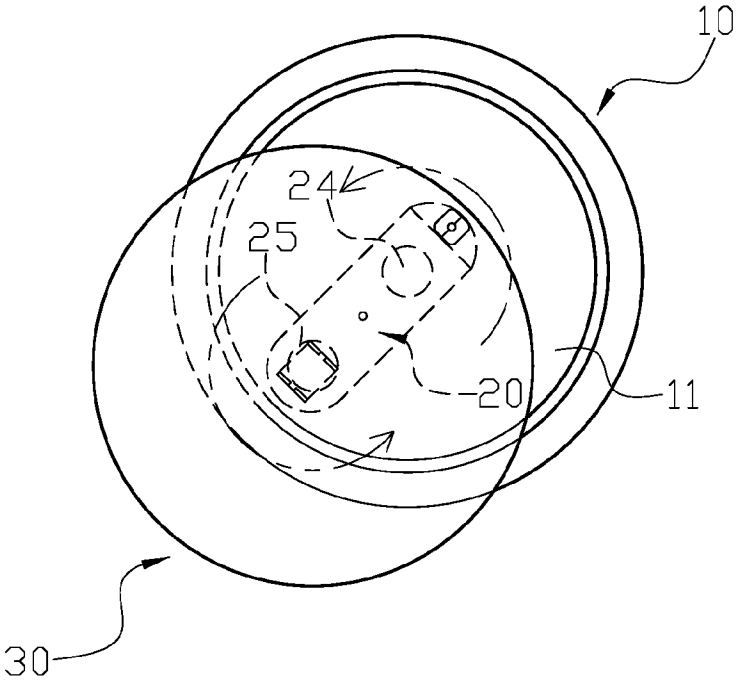
FIG. 17 is still a further plan view when the waist twisting apparatus of the present invention is in use.
Figure 16:
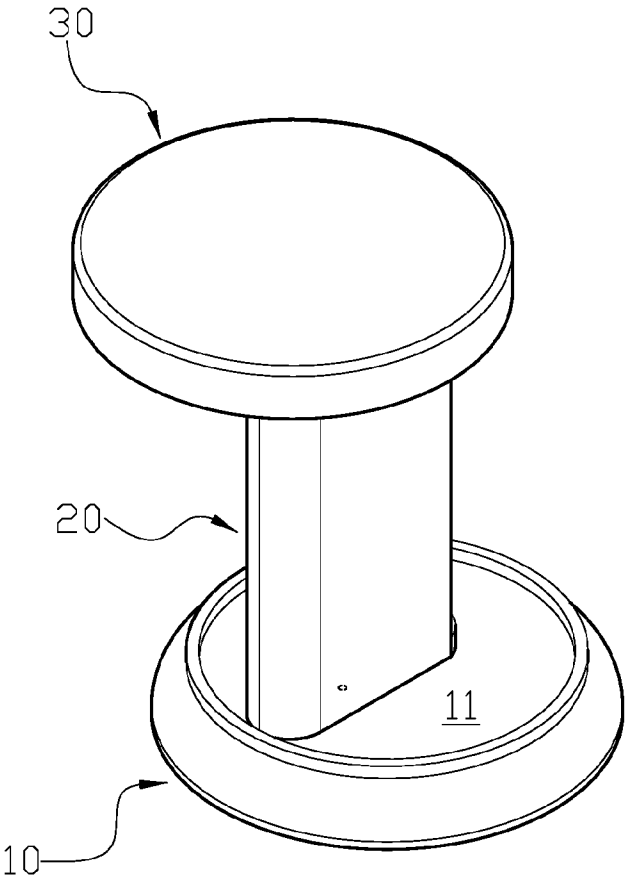
FIG. 16 is still a further three-dimensional view when the waist twisting apparatus of the present invention is in use.
Figure 18:
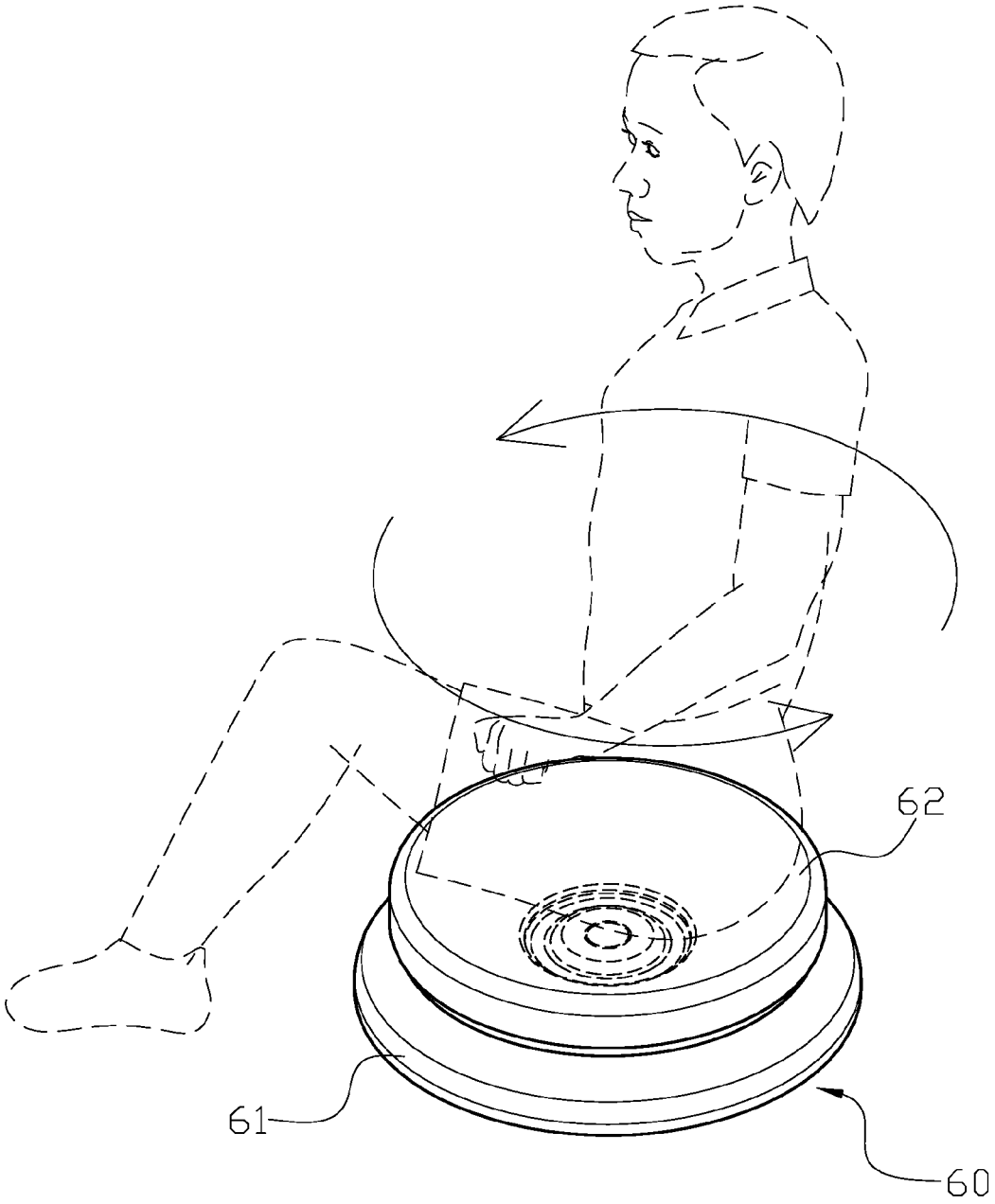
FIG. 18 PRIOR ART
FIG. 18 is a prior art.
Figure 19:
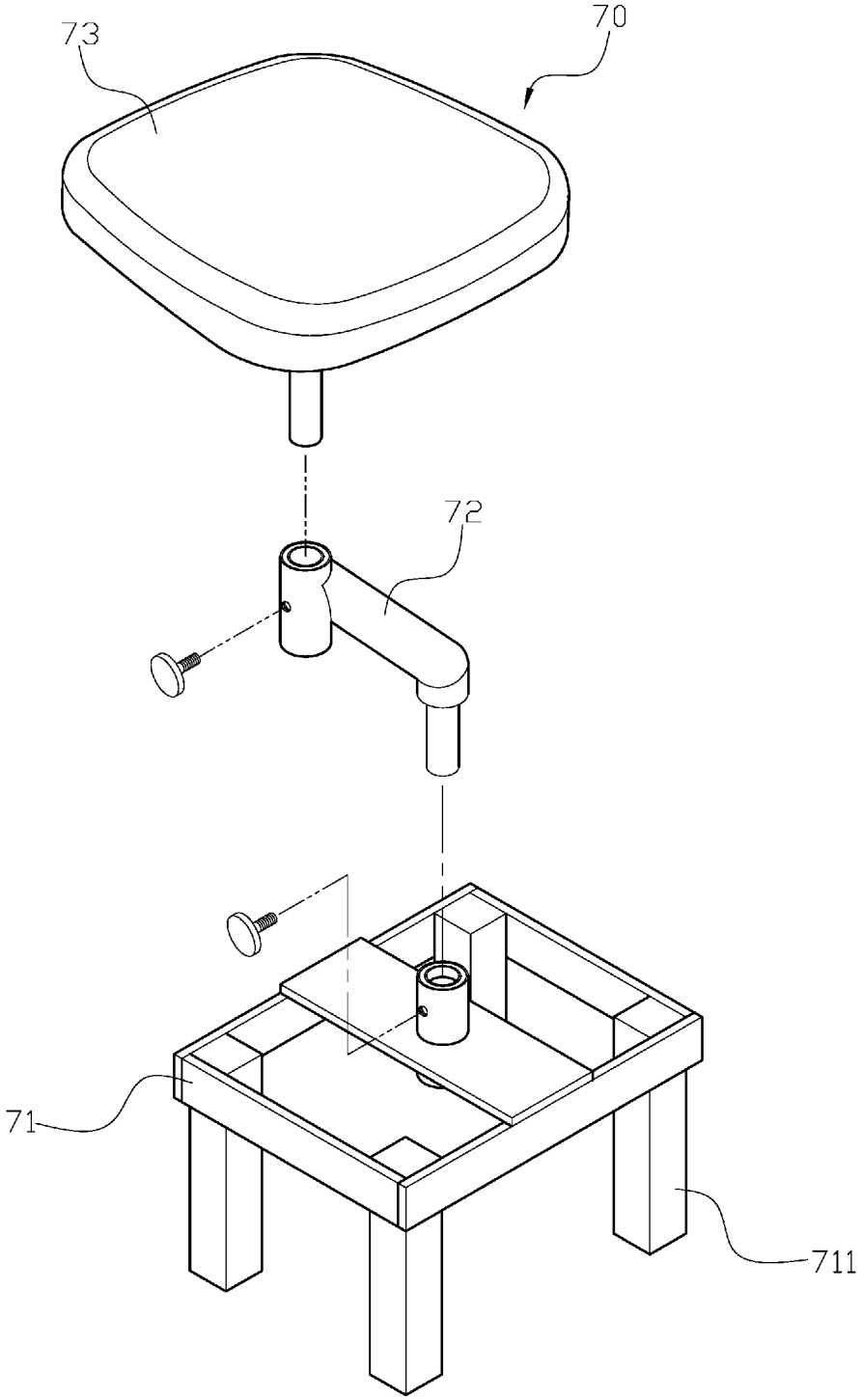
FIG. 19 PRIOR ART
FIG. 19 is a prior art.
Figure 20:
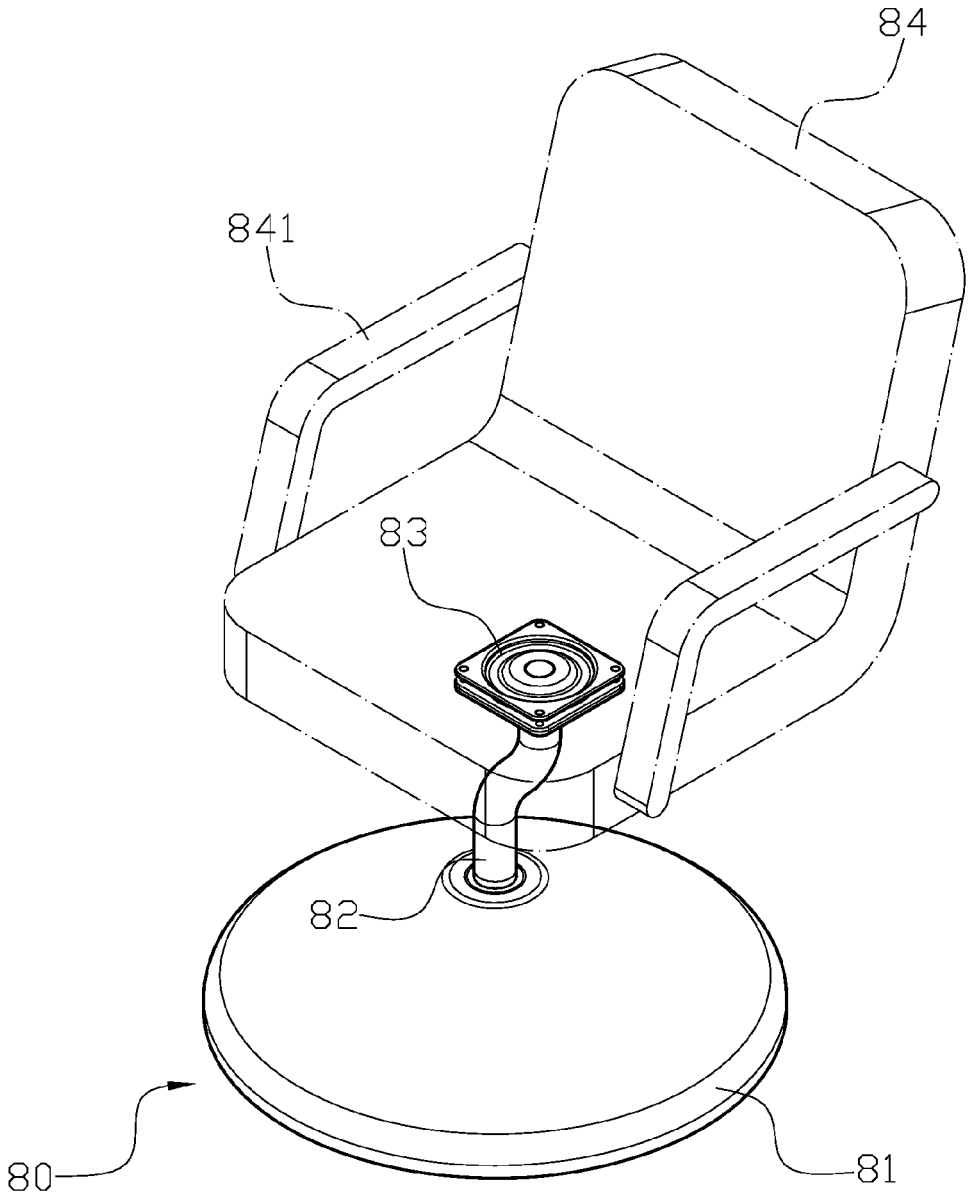
FIG. 20 PRIOR ART
FIG. 20 is a prior art.

In addition, a connecting hole (27) is formed on the first edge (22) of the supporting portion (20), and a protruding portion (28) laterally protrudes from a lower portion of the first edge (22). A locating hole (281) penetrates through the protruding portion (28), and a mounting hole (13) is formed on the platform (11) of the base (10). Thus, a bolt (50) can be downwardly inserted through the locating hole (281) into the mounting hole (13) (as shown in FIGS. 4 and 5). Before the user sitting on the seat (30), the bolt (50) is inserted through the locating hole (281) into the mounting hole (13) to secure the supporting portion (20) on the base (10). After sitting on the seat (30), the user can pull the bolt (50) out from the locating hole (281) and the mounting hole (13), and insert the bolt (50) into the connecting hole (27) (as shown in FIGS. 6 and 7) to start waist twisting exercise. With the design of the locating hole (281), mounting hole (13) and the connecting hole (27), the waist twisting apparatus in the present invention can improve the safety of use and lower the risk of losing the bolt (50).

In one embodiment, the main body (21) of the supporting portion (20) is composed of two pieces of shell bodies (211).

In another embodiment, the bottom shell (31) can be used as the seat (30) to provide a seat for the user.

In still another embodiment, the bottom shell (31) of the seat (30) is connected to a cushion (33), and a seat cover (34) is covered around the cushion (33) and the bottom shell (31). Also, the seat cover (34) is made of fabric or leather.

In actual application, the seat (30) is configured for the user to sit thereon, and the wheel (26) configured to support the weight of the user in an eccentric position of the platform (11) can use a first axle rod (24) as a pivotal axis to circularly slide on the platform (11) of the base (10). Since the height of the seat (30) is slightly higher than the height of the knee of general adult user, the feet of the user can stand on the floor comfortably when sitting on the seat (30) (as shown in FIG. 4). After the user sitting on the seat (30), the bolt (50) can be pulled out from the locating hole (281) and the mounting hole (13) and inserted into the connecting hole (27) of the supporting portion (20) (as shown in FIG. 6) to start twisting exercise. Moreover, during the twisting exercise, the user sitting on the seat (30) can use the feet on the floor as a pivot point to twist the waist and the lower body, and further achieve swing movement together with the seat (30). When the seat (30) is swung, the main body (21) of the supporting portion (20) can use the first axle hole (12) of the base (10) as a rotating center to enable the wheel (26) to circularly slide on the eccentric position of the platform (11). Since the supporting portion (20) is connected to the seat (30) through the second axle rod (25), the seat (30) can achieve the self-rotation relative to the supporting portion (20) (as shown in FIGS. 7 to 17). Moreover, since the wheel (26) supports the weight of the user and slides on the eccentric position of the platform (11), the oblique force generated during the twisting exercise can be reduced effectively, thus allowing the user to achieve the twisting movement easily. Furthermore, since the seat (30) can be rotated about the second axle rod (25), the seat (30) can keep facing the same direction during the swing movement, thus enhancing the effect of strengthening the waist and the lower body of the user.

Comparing with conventional waist twisting apparatus, the present invention is advantageous because: (i) the height of the seat (30) is slightly higher than the knee of general adult user, so that the user can comfortably sit on the seat (30) without over bending knees or crossing legs, thus lowering the possibility of injuries during the twisting exercise and enhancing the exercise effect; (ii) since the first axle rod (24) and the second axle rod (25) are installed inside the main body (21) instead of being exposed to the air, the first axle rod (24) and the second axle rod (25) are less likely to be stuck by foreign matters such as dusts; (iii) when the waist twisting apparatus in the present invention is in used, the feet of the user can stand on the floor, so that there is no need to install the handle for providing a handhold for the user, thus lowering the complexity in structure, improving the exercise effect and preventing the user from getting hurt; (iv) the user together with the seat (30) is supported by the wheel (26) instead of being hanged on the air, so that the structure can prevent the base (10) from being pushed from the oblique lower direction by the first axle rod (24), thus smoothing the rotation of the supporting portion (20); (v) by pivotally connecting the base (10), the supporting portion (20) and the seat (30), the waist twisting apparatus in the present invention has advantages in simplifying the structure, reducing the volume, and lowering the difficulty of assembling and the cost of produce; and (vi) since the bolt (50) can secure the supporting portion (20) together with the seat (30) on the base (10), the waist twisting apparatus in the present invention can also be used as a chair for a user.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A waist twisting apparatus comprising:

a base comprising a platform formed at a top portion thereof, and a central portion of the platform having a first axle hole, a supporting portion vertically coupled to the base comprising a main body, and a first axle rod coupled to a lower inner portion of the main body and configured to connect to the first axle hole, wherein the main body has a vertical first edge and a vertical second edge, the vertical first edge being positioned adjacent the first axle rod and the vertical second edge being positioned opposite the vertical first edge and farther away from the first axle rod, and a second axle rod is coupled to an upper outer portion of the main body and is positioned adjacent to the vertical second edge of the main body, wherein the first axle rod comprises a first connecting portion which downwardly sticks out of a bottom portion of the main body, and the second axle rod has a second connecting portion which upwardly protrudes from a top portion of the main body, a wheel is pivotally installed at the bottom portion of the main body and is positioned adjacent to the vertical second edge; and a seat comprising a bottom shell, and a second axle hole is formed at a center bottom portion of the bottom shell, wherein the supporting portion is downwardly connected to the base by inserting the first connecting portion into the first axle hole, and is upwardly connected to the seat by inserting the second connecting portion into the second axle hole, so that each of the base and the seat is configured to respectively rotate about the first connecting portion and the second connecting portion of the supporting portion, and the wheel contacts the platform of the base, wherein the supporting portion is configured such that a height of the seat is higher than a height of a user's knee.

2. The waist twisting apparatus of claim 1, wherein each of the first axle hole of the base and the second axle hole of the seat respectively has two bearings which are configured to allow the first connecting portion and the second connecting portion to rotate about the first axle hole and the second axle hole respectively.

3. The waist twisting apparatus of claim 2, wherein each of the first connecting portion and the second connecting portion is connected to the bearings in a cone-shaped coordination.

4. The waist twisting apparatus of claim 1, wherein a connecting hole is formed on the vertical first edge of the supporting portion, and a protruding portion protrudes from a lower portion of the vertical first edge, and a locating hole penetrates through the protruding portion, and a mounting hole is formed on the platform of the base, so that a bolt is configured to be inserted downwardly through the locating hole into the mounting hole to secure the supporting portion on the base.

5. The waist twisting apparatus of claim 1, wherein the main body of the supporting portion is composed of two pieces of shell bodies.

6. The waist twisting apparatus of claim 1, wherein the bottom shell is configured to be used as the seat so that the user is able to directly sit thereon.

7. The waist twisting apparatus of claim 1, wherein a cushion is connected to a top portion of the bottom shell of the seat, and a seat cover is covered around the cushion and the bottom shell, and the seat cover is made of fabric.

8. The waist twisting apparatus of claim 7, wherein the cushion is connected to the top portion of the bottom shell of the seat, and the seat cover is covered around the cushion and the bottom shell, and the seat cover is made of leather.

* * * * *